US008038269B2

(12) United States Patent
Umeda

(10) Patent No.: US 8,038,269 B2
(45) Date of Patent: Oct. 18, 2011

(54) LIQUID EJECTING DEVICE

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 510 days.

(21) Appl. No.: 12/199,513

(22) Filed: Aug. 27, 2008

(65) Prior Publication Data

US 2009/0058970 A1 Mar. 5, 2009

(30) Foreign Application Priority Data

Aug. 28, 2007 (JP) ..... 2007-221040

(51) Int. Cl.
*B41J 2/175* (2006.01)

(52) U.S. Cl. ..... 347/85; 347/92; 347/93

(58) Field of Classification Search ..... 347/84, 347/85, 86, 93, 92, 20
See application file for complete search history.

(56) References Cited

U.S. PATENT DOCUMENTS

| | | | | |
|---|---|---|---|---|
| 6,457,820 | B1 * | 10/2002 | Cai et al. | 347/92 |
| 6,755,500 | B2 * | 6/2004 | Hirano et al. | 347/85 |
| 2006/0137526 | A1 | 6/2006 | Ueda | |
| 2007/0046747 | A1 * | 3/2007 | Takemoto | 347/92 |

FOREIGN PATENT DOCUMENTS

| | | | |
|---|---|---|---|
| JP | 2005288770 | A | 10/2005 |
| JP | 2006206190 | A | 8/2006 |

* cited by examiner

*Primary Examiner* — Manish S Shah
(74) *Attorney, Agent, or Firm* — Baker Botts L.L.P.

(57) ABSTRACT

A liquid ejecting device is provided. The liquid ejecting device includes: a liquid ejecting head including a nozzle for ejecting a liquid; a liquid supply channel for supplying the liquid to the liquid ejecting head; a discharge channel for discharging a gas in the liquid supply channel; a gas permeable film disposed in a connecting portion between the liquid supply channel and the discharge channel, the gas permeable film partitioning the liquid supply channel and the discharge channel; and a suction unit connected to the discharge channel so as to suction the gas in the discharge channel, wherein the liquid supply channel includes a first liquid flow channel extending in an extending direction intersecting a horizontal direction, and wherein the gas permeable film defines a part of the first liquid flow channel extending in the extending direction.

8 Claims, 12 Drawing Sheets

SHEET CONVEYING DIRECTION
3
22
23
44a
44b
44c
44d
45a
45b
45c
45d
46a
46b
46c
46d
47a
47b
47c
47d
48a
48b
48c
48d
49
50
51
60
61
62
63
65
70a
70b
70c
70d
42a
42b
42c
42d
43a
43b
43c
43d
89

LIQUID EJECTING DEVICE

CROSS-REFERENCE TO RELATED APPLICATION

This application claims priority from Japanese Patent Application No. 2007-221040, filed on Aug. 28, 2007, the entire subject matter of which is incorporated herein by reference.

TECHNICAL FIELD

Aspects of the present invention relate to a liquid ejecting device ejecting a liquid from nozzles.

BACKGROUND

JP-A-2005-288770 describes an ink-jet printing device in which a sub-tank containing ink to be supplied to a print head is partitioned vertically by a ventilation film (gas permeable film), a part below the ventilation film serves as an ink chamber (liquid supply channel) containing ink, and a part above the ventilation film serves as an air chamber (discharge channel) to which air in the ink chamber is discharged. The air chamber is connected to a deaeration pump with a valve interposed therebetween, and the air in the air chamber and the ink chamber is discharged externally by actuating the deaeration pump with the valve opened to suction the air in the air chamber. By closing the valve after suctioning the air in the air chamber by actuating the deaeration pump, the air chamber is maintained in reduced pressure and then the air flowing in the ink chamber is discharged to the air chamber due to the reduced pressure of the air chamber. Accordingly, it is possible to prevent the air from flowing into the print head together with the ink at the time of supplying the ink from the ink chamber to the print head.

In JP-A-2005-288770, since air flowing in the ink chamber is lighter than the ink, the air is accumulated sequentially from the upper portion of the ink chamber, that is, the portion close to the ventilation film. Accordingly, in JP-A-2005-288770, when a large amount of gas flows in the ink chamber, the gas is accumulated at a position apart from the ventilation film and thus the gas accumulated at the position may not be efficiently discharged to the air chamber.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a liquid ejecting device which is able to efficiently discharge gas in a liquid supply channel even when a large amount of gas flows in the liquid supply channel supplying a liquid to a liquid ejecting head.

According to an exemplary embodiment of the present invention, there is provided a liquid ejecting device including: a liquid ejecting head including a nozzle for ejecting a liquid; a liquid supply channel connected to the liquid ejecting head to supply the liquid to the liquid ejecting head; a discharge channel connected to the liquid supply channel through a connecting portion to discharge a gas in the liquid supply channel; a gas permeable film disposed in the connecting portion between the liquid supply channel and the discharge channel, the gas permeable film configured to pass the gas and do not pass the liquid, the gas permeable film partitioning the liquid supply channel and the discharge channel; and a suction unit connected to the discharge channel so as to suction the gas in the discharge channel, wherein the liquid supply channel includes a first liquid flow channel extending in an extending direction intersecting a horizontal direction, and wherein the gas permeable film defines a part of the first liquid flow channel extending in the extending direction.

According to another exemplary embodiment of the present invention, there is provided a liquid ejecting device including: a liquid ejecting head including a nozzle surface, the nozzle surface including a nozzle for ejecting a liquid; a liquid supply channel connected to the liquid ejecting head to supply the liquid to the liquid ejecting head; a discharge channel connectable to a suction pump which suctions a gas in the liquid supply channel through the discharge channel; and a gas permeable film which passes the gas and does not pass the liquid, and which is disposed between the liquid supply channel and the discharge channel and defines a part of the liquid containing unit and a part of the discharge channel, wherein the liquid supply channel extends in a direction intersecting the nozzle surface, and wherein the gas permeable film is provided such that as an amount of the liquid in the liquid supply channel reduces, a contacting area between the gas permeable film and the liquid in the liquid supply channel reduces.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Hereinafter, exemplary embodiments of the present invention will be described.

Figure 1:
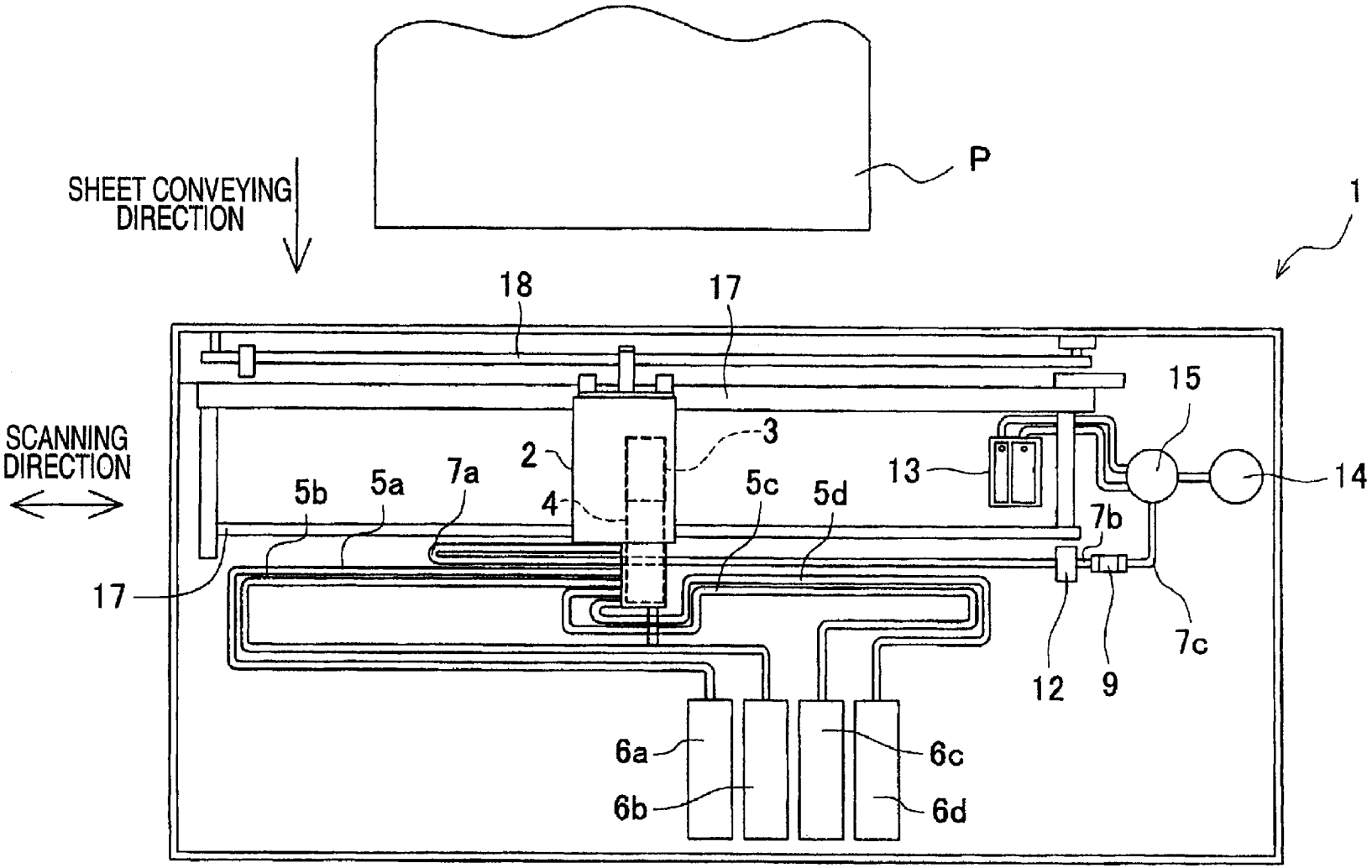
FIG. 1 is a diagram schematically illustrating a configuration of a printer according to an exemplary embodiment of the invention.

FIG. 1 is a diagram schematically illustrating a configuration of a printer according to an exemplary embodiment of the invention. As shown in FIG. 1, the printer 1 includes a carriage 2, an ink-jet head 3, a sub-tank 4, ink cartridges 6*a* to 6*d*, tubes 5*a* to 5*d*, tubes 7*a* to 7*c*, a differential pressure regulating valve 9, a charge tank 12, an ink suction cap 13, a suction pump 14, and a switching unit 15.

The carriage 2 is driven by a driving mechanism 18 and reciprocates in a scanning direction along two guide shafts 17 extending in parallel in the horizontal direction (scanning direction) of FIG. 1. The ink-jet head 3 is mounted on the carriage 2 and ejects ink (liquid) from nozzles 95 (see FIG. 5) formed on the bottom surface (nozzle surface) thereof onto a printing sheet P conveyed to the down side in FIG. 1 (in a sheet conveying direction) by a sheet conveying mechanism (not shown) while reciprocating in the scanning direction together with the carriage 2. Accordingly, an image is printed onto the printing sheet P. It is noted that the nozzle surface is parallel to the horizontal direction and an ejecting direction of the ink from the nozzles 95 is perpendicular to the horizontal direction.

The sub-tank 4 is mounted on the carriage 2 and ink to be supplied to the ink-jet head 3 is temporarily contained in the sub-tank 4. The ink cartridges 6*a* to 6*d* are connected to the tubes 5*a* to 5*d*. Ink of black, yellow, cyan, and magenta to be supplied to the ink-jet head 3 is contained in the ink cartridges 6*a* to 6*d*, respectively.

The tubes 5*a* to 5*d* have one end connected to the sub-tank 4 and the other end connected to the ink cartridges 6*a* to 6*d*. Four colors of ink contained in the ink cartridges 6*a* to 6*d* are supplied to the sub-tank 4 through the tubes 5*a* to 5*b*, respectively. Accordingly, four colors of ink are supplied from the sub-tank 4 to the inkjet head 3 and four colors of ink are ejected from the nozzles 95 (see FIG. 5).

The tube 7*a* connects the sub-tank 4 and the charge tank 12, the tube 7*b* connects the charge tank 12 and the differential pressure regulating valve 9, and the tube 7*c* connects the differential pressure regulating valve 9 and the switching unit 15. Accordingly, the sub-tank 4 and the switching unit 15 are connected through the tubes 7*a* to 7*c*, the charge tank 12, and the differential pressure regulating valve 9. A gas flow channel extending from a gas chamber 49 (described later) of the sub-tank 4 to the switching unit 15 through a discharge unit 23 (see FIG. 2), the tube 7*a*, the charge tank 12, the tube 7*b*, the differential pressure regulating valve 9, and the tube 7*c* corresponds to a discharge channel.

As described later, the differential pressure regulating valve 9 switches the communication states (communicating state or communication blocked state) between the tube 7*a* and the tube 7*b*, thereby switching the communication states between the discharge channel and the suction pump 14. As described later, when a portion of the discharge channel between the sub-tank 4 and the differential pressure regulating valve 9 is maintained in a negative pressure, the charge tank 12 serves to elongate the duration of the negative pressure.

The ink suction cap 13 is disposed to face the bottom surface of the ink-jet head 3 when the carriage 2 is located at the rightmost position of FIG. 1 in a movable range of the carriage 2, and moves in a direction departing forward from the paper surface of FIG. 1 to cover the nozzles 95 formed in the bottom surface of the ink-jet head 3 when the ink-jet head 3 is located at the position facing the ink suction cap 13. The ink suction cap 13 is connected to the switching unit 15.

The suction pump 14 is connected to the switching unit 15. The switching unit 15 selectively connects the suction pump 14 to one of the tube 7*c* and the ink suction cap 13. By actuating the suction pump 14 in the state where the suction pump 14 is connected to the tube 7*c* by the switching unit 15, it is possible to suction the gas in the discharge channel from the tube 7*c*. In addition, by actuating the suction pump 14 in the state where the suction pump 14 and the ink suction cap 13 are connected to each other by the switching unit 15, it is possible to suction the thickened ink in the ink-jet head 3 from the nozzles 95 (see FIG. 5).

Figure 2:
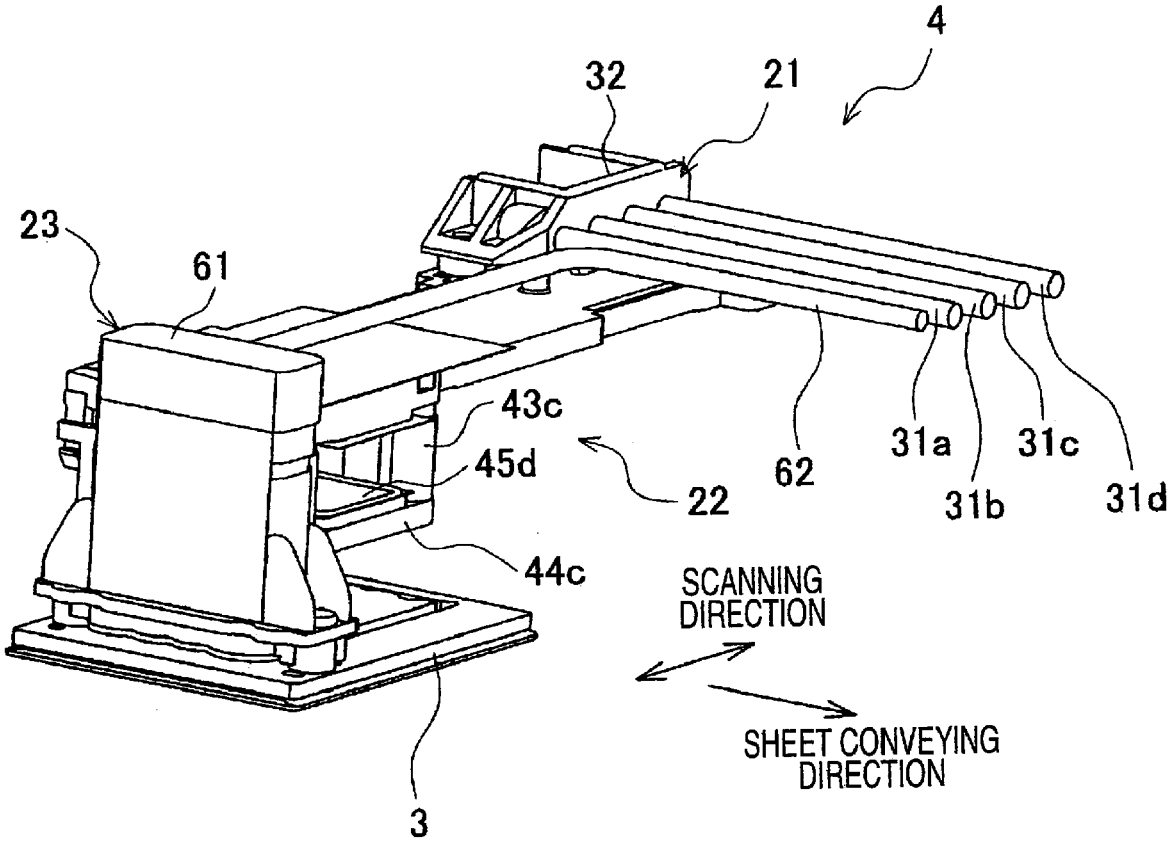
FIG. 2 is a perspective view schematically illustrating a sub-tank shown in FIG. 1.
Figure 3:
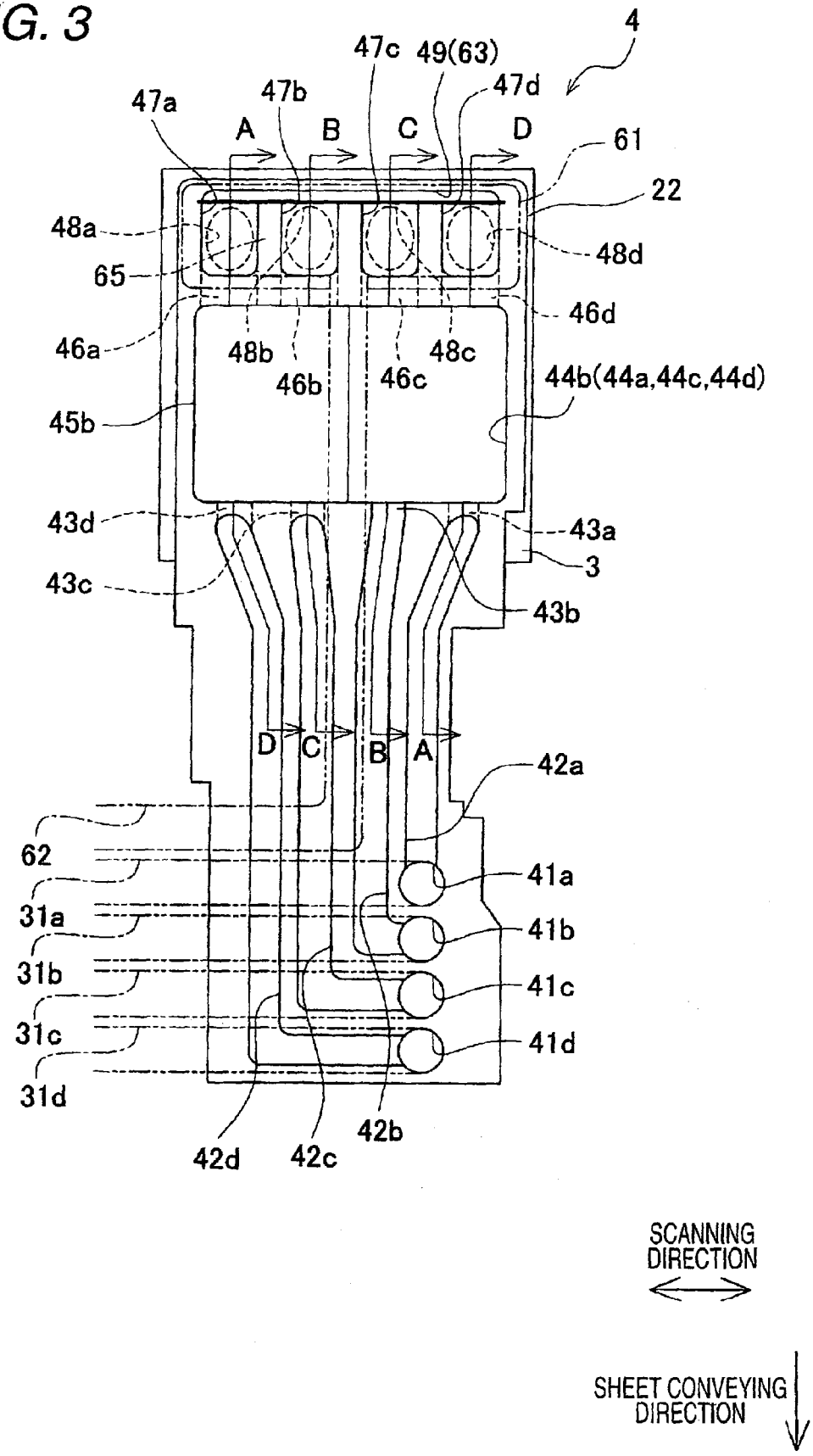
FIG. 3 is a plan view of the sub-tank shown in FIG. 2.
Figures 4A, 4B, 4C, 4D:
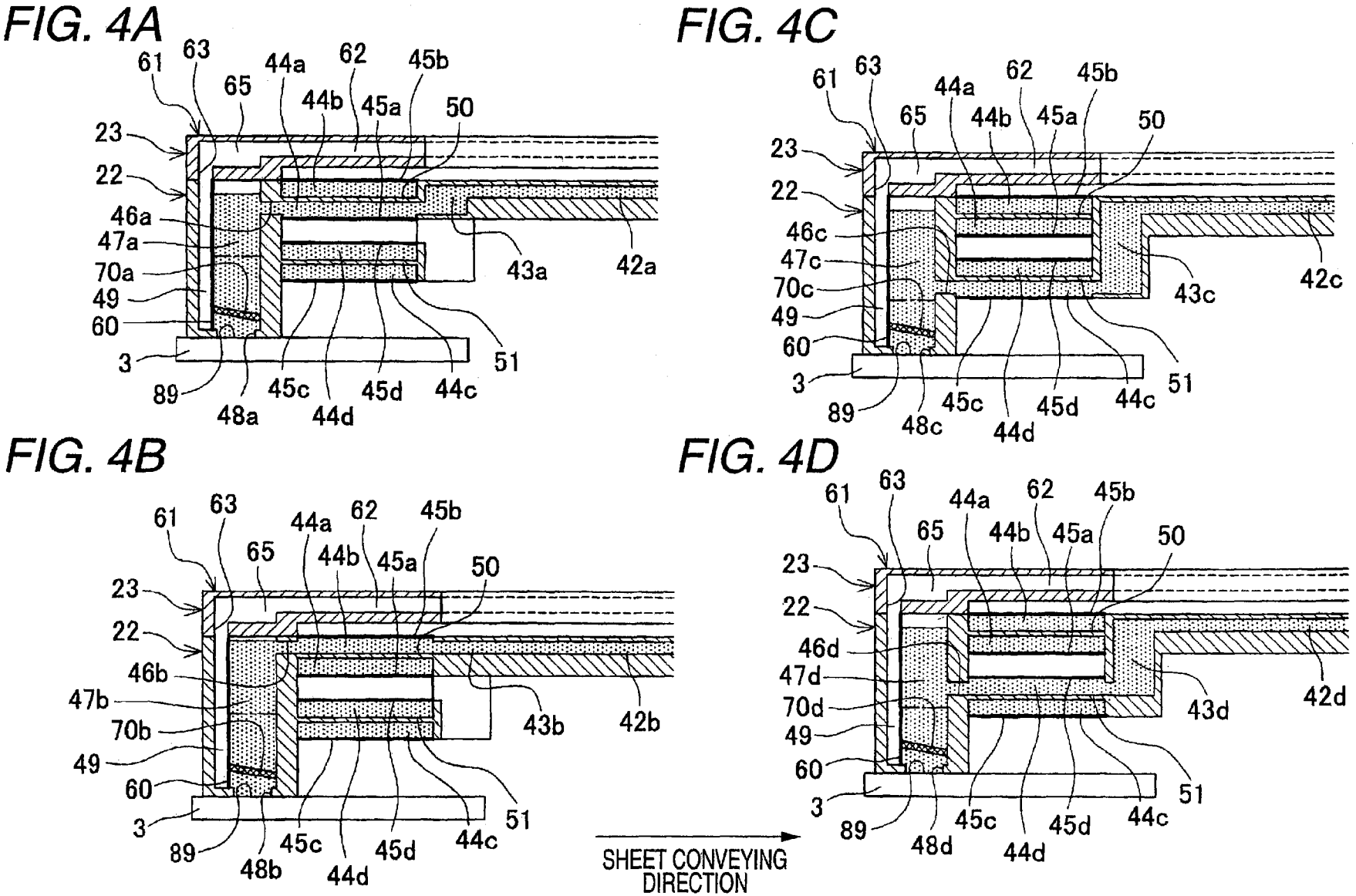
FIG. 4A is a sectional view taken along line A-A of FIG. 3.
FIG. 4B is a sectional view taken along line B-B of FIG. 3.
FIG. 4C is a sectional view taken along line C-C of FIG. 3.
FIG. 4D is a sectional view taken along line D-D of FIG. 3.

The sub-tank 4 is described herein. FIG. 2 is a perspective view schematically illustrating the sub-tank 4 shown in FIG. 1. FIG. 3 is a plan view of FIG. 2. FIG. 4A is a sectional view taken along line A-A of FIG. 3. FIG. 4B is a sectional view taken along line B-B of FIG. 3. FIG. 4C is a sectional view taken along line C-C of FIG. 3. FIG. 4D is a sectional view taken along line D-D of FIG. 3. For the purpose of easily understanding the drawings, in FIG. 3, inflow tubes 31*a* to 31*d* of a connection unit 21 (described later) and a discharge unit 23 (described later) are indicated by a two-dot chained line, and parts of a connecting portion 32 of the connection unit 21 and a sub-tank body 22 are not shown. As shown in FIGS. 2 to 4D, the sub-tank 4 includes a connection unit 21, a sub-tank body 22, and a discharge unit 23.

The connection unit 21 connects the tubes 5*a* to 5*d* to the sub-tank 4 and includes inflow tubes 31*a* to 31*d* and a connecting portion 32. The inflow tubes 31*a* to 31*d* are cylindrical tubes extending in the sheet conveying direction in parallel to one another and are arranged in the scanning direction with a constant interval. The front ends of the inflow tubes 31*a* to 31*d* in FIG. 2 are connected to the tubes 5*a* to 5*d* (not shown in FIGS. 2 and 3) and the back ends thereof in FIG. 2 are connected to the connecting portion 32. The connecting portion 32 is bonded to the top surface of the sub-tank body 22 at one end in the scanning direction to allow the inflow tubes 31*a* to 31*d* to communicate with connection holes 41*a* to 41*d* of the sub-tank body 22 (described later).

The sub-tank body 22 includes connection holes 41*a* to 41*d*, ink flow channels 42*a* to 42*d*, 43*a* to 43*d*, 46*a* to 46*d*, and 47*a* to 47*d*, ink containing chambers 44*a* to 44*d*, damper films 45*a* to 45*d*, a gas chamber 49, a gas permeable film 60, and filters 70*a* to 70*d*. The connection holes 41*a* to 41*d* have a substantially circular shape in a plan view and are arranged in the vertical direction of FIG. 3 at the lower-right end of the sub-tank body 22 in FIG. 3. The sub-tank body 22 is supplied with the ink from the connection holes 41*a* to 41*d*.

The ink flow channel 42*a* extends to the upside of FIG. 3 from the connection hole 41*a*, is bent to the upper-right side of FIG. 3 in the middle way, and extends to the position of the ink containing chambers 44*a* to 44*d* in the vicinity of the downside thereof in FIG. 3.

The ink flow channel 42*b* extends to the left side of FIG. 3 from the connection hole 41*b*, is bent upward in the drawing in the middle way, is bent again to the upper-right side of FIG. 3 in the middle way, and extends to the position of the ink containing chambers 44*a* to 44*d* in the vicinity of the downside thereof in FIG. 3.

The ink flow channel 42*c* extends to the left side of FIG. 3 from the connection hole 41*c*, is bent upward in the drawing in the middle way, is bent again to the upper-left side of FIG. 3 in the middle way, and extends to the position of the ink containing chambers 44*a* to 44*d* in the vicinity of the downside thereof in FIG. 3.

The ink flow channel 42*d* extends to the left side of FIG. 3 from the connection hole 41*d*, is bent upward in the drawing in the middle way, is bent again to the upper-left side of FIG. 3 in the middle way, and extends to the position of the ink containing chambers 44*a* to 44*d* in the vicinity of the downside thereof in FIG. 3.

By arranging the ink flow channels 42*a* to 42*d* as described above, the portions extending to the upside and the downside of FIG. 3 are arranged in the horizontal direction of FIG. 3 in the order of the ink flow channels 42*a*, 42*b*, 42*c*, and 42*d* from the right side.

The ink containing chambers 44*a* to 44*d* are arranged at positions of the ink flow channels 42*a* to 42*d* in the vicinity of the upper end thereof in FIG. 3 so as to overlap with each other in the plan view. The ink containing chambers 44*b*, 44*a*, 44*d*, and 44*c* are sequentially arranged in this order in the vertical direction as shown in FIGS. 4A to 4D. The ink containing chambers 44*a* to 44*d* have a substantially rectangular shape longitudinally extending in the horizontal direction of FIG. 3 in the plan view.

The upper surface of the ink containing chamber 44*b* and the lower surface of the ink containing chamber 44*a* are provided with the damper films 45*b* and 45*a*, respectively. The damper films 45*b* and 45*a* serve as walls defining the upper surface of the ink containing chamber 44*b* and the lower surface of the ink containing chamber 44*a*. A partition wall 50 is disposed between the ink containing chamber 44*b* and the ink containing chamber 44*a*, and the ink containing chamber 44*b* and the ink containing chamber 44*a* are partitioned by the partition wall 50.

The upper surface of the ink containing chamber 44*d* and the lower surface of the ink containing chamber 44*c* are provided with the damper films 45*d* and 45*c*, respectively. The damper films 45*d* and 45*c* serve as walls defining the upper surface of the ink containing chamber 44*d* and the lower surface of the ink containing chamber 44*c*. A partition wall 51 is disposed between the ink containing chamber 44*d* and the ink containing chamber 44*c*, and the ink containing chamber 44*d* and the ink containing chamber 44*c* are partitioned by the partition wall 51. A space is formed between the ink containing chamber 44*a* and the ink containing chamber 44*d* (between the damper film 45*a* and the damper film 45*d*).

Here, when the sub-tank 4 reciprocates in the scanning direction along with the carriage 2 at the time of performing a printing operation and the like, the ink in the sub-tank 4 vibrates to cause a variation in pressure of the sub-tank 4. However, since the damper films 45*a* to 45*d* are deformed, the variation in pressure of the ink is suppressed.

The ink flow channel 43*a* extends from the front end (upper end in FIG. 3) of the ink flow channel 42*a* to the same height as the ink containing chamber 44*a* (downside in FIG. 4A), is bent to the left of FIG. 4A at the position, and is then connected to the ink containing chamber 44*a*.

The ink flow channel 43*b* extends from the front end (upper end in FIG. 2) of the ink flow channel 42*b* in the extending direction (to the left side of FIG. 4B) of the ink flow channel 42*b* and is then connected to the ink containing chamber 44*b*. The ink flow channel 43*c* extends from the front end (upper end in FIG. 3) of the ink flow channel 42*c* to the same height as the ink containing chamber 44*c* (downside in FIG. 4C), is bent to the left of FIG. 4C at the position, and is then connected to the ink containing chamber 44*c*.

The ink flow channel 43*d* extends from the front end (upper end in FIG. 3) of the ink flow channel 42*d* to the same height as the ink containing chamber 44*d* (downside in FIG. 4D), is bent to the left of FIG. 4D at the position, and is then connected to the ink containing chamber 44*d*.

The ink flow channels 46*a* to 46*d* (second liquid flow channels) extend from the left ends of the ink containing chambers 44*a* to 44*d* in FIGS. 4A to 4D in the horizontal direction (to the left side in the drawings) and are connected to the ink flow channels 47*a* to 47*d*, respectively. The ink flow channels 47*a* to 47*d* (first liquid flow channels) extend in the vertical direction (in the direction perpendicular to the horizontal direction) and are arranged from the left of FIG. 3 in the horizontal direction of FIG. 3 in the order of the ink flow channels 47*a*, 47*b*, 47*c*, and 47*d*.

The lower ends of the ink flow channels 47*a* to 47*d* are ink supply ports 48*a* to 48*d* of which the lower ends are opened, and the ink supply ports 48*a* to 48*d* are connected to the ink supply holes 89 (see FIG. 5) formed in the top surface of the ink-jet head 3. That is, the ink-jet head 3 is connected to the downstream end of the ink flow channels 47*a* to 47*d*. The ink in the ink flow channels 47*a* to 47*d* are supplied from the ink supply ports 48*a* to 48*d* to the ink-jet head 3.

The gas chamber 49 is formed at a position overlapping the ink flow channels 47*a* to 47*d* as viewed in the horizontal direction in FIGS. 4A to 4D so as to cover the ink flow channels 47*a* to 47*d*. The gas permeable film 60 is disposed between the ink flow channels 47*a* to 47*d* and the gas chamber 49 so as to cover the ink flow channels 47*a* to 47*d*, and extends in the vertical direction. The gas permeable film 60 forms left side walls (a part of walls along the extending direction) of the ink flow channels 47*a* to 47*d* in FIGS. 4A to 4D and serves as a wall partitioning the ink flow channels 47*a* to 47*d* and the gas chamber 49.

The gas permeable film 60 passes only gas and does not pass ink or liquid other than gas. Accordingly, when the gas in the discharge channel is suctioned by the suction pump 14 or when the pressure of the discharge channel is maintained in a negative pressure lower than the atmospheric pressure as described later, only the gas in the ink flow channels 47*a* to 47*d* is suctioned due to the negative pressure of the discharge channel and is discharged to the gas chamber 49 (discharge channel).

The filters 70*a* to 70*d* serve to remove particles in the ink in the ink flow channels 47*a* to 47*d* and are disposed at positions overlapping the gas permeable film 60 in the horizontal direction in the vicinity of the ink supply ports 48*a* to 48*d* of the ink flow channels 47*a* to 47*d*, respectively. The filters 70*a* to 70*d* are tilted about the horizontal direction so that a left portion (portion closer to the gas permeable film 60) in FIGS. 4A to 4D is located higher, and the left end in FIGS. 4A to 4D is connected to the gas permeable film 60.

In the ink flow channels 47*a* to 47*d*, bubbles can be easily attached to the surfaces of the filters 70*a* to 70*d*. When the bubbles attached to the filters 70*a* to 70*d* stay, the bubbles may flow into the ink-jet head 3 along with the ink, thereby causing a variation in ink ejection characteristic of the nozzles 95 (see FIG. 5). However, in this exemplary embodiment, since the filters 70*a* to 70*d* are located at the positions overlapping with the gas permeable film 60 in the horizontal direction and the left end in FIGS. 4A to 4D is connected to the gas permeable film 60, the bubbles attached to the filters 70*a* to 70*d* are discharged to the gas chamber 49 through the gas permeable film 60.

The bubbles can easily stay particularly on the lower surfaces of the filters 70*a* to 70*d*. However, since the filters 70*a* to 70*d* are tilted about the horizontal direction so that the portion closer to the left in FIGS. 4A to 4D is located higher, the gas attached to the lower surfaces of the filters 70*a* to 70*d* move to the vicinity of the gas permeable film 60 to the upper-left side in FIGS. 4A to 4D along the lower surfaces of the filters 70*a* to 70*d*. Accordingly, it is possible to efficiently discharge the gas attached to the lower surfaces of the filters 70*a* to 70*d* to the gas chamber 49.

In the printer 1, the ink in the ink cartridges 6*a* to 6*d* flows into the inflow tubes 31*a* to 31*d* from the tubes 5*a* to 5*d* and flows into the ink containing chambers 44*a* to 44*d* through the connection holes 41*a* to 41*d* and the ink flow channels 42*a* to 42*d* and 43*a* to 43*d*, respectively. The ink temporarily contained in the ink containing chambers 44*a* to 44*d* flows into the ink flow channels 47*a* to 47*d* from the ink flow channels 46*a* to 46*d* and is then supplied to the inkjet head 3 through the ink supply ports 48*a* to 48*d* after the particles are removed therefrom by the filters 70*a* to 70*d*, respectively.

The flow channels extending from the ink cartridges 6*a* to 6*d* to the ink-jet head 3 through the tubes 5*a* to 5*d*, the inflow tubes 31*a* to 31*d*, the connection holes 41*a* to 41*d*, the ink flow channels 42*a* to 42*d* and 43*a* to 43*d*, the ink containing chambers 44*a* to 44*d*, and the ink flow channels 46*a* to 46*d* and 47*a* to 47*d* correspond to the liquid supply channels.

Here, the ink flow channels 47*a* to 47*d* and the gas permeable film 60 extend in the vertical direction (the direction intersecting the horizontal direction). Accordingly, when the gas flows into the ink flow channels 47*a* to 47*d*, the liquid level of the ink in the ink channels 47*a* to 47*d* is lowered more as the amount of gas flowing therein becomes more, for example, as indicated by a dot dashed line in FIGS. 4A to 4D. As the liquid level of the ink is lowered, the contact area between the gas in the ink flow channels 47*a* to 47*d* and the gas permeable film 60 increases. Accordingly, even when a large amount of gas flows into the sub-tank 4 from the ink cartridges 6*a* to 6*d*, it is possible to efficiently discharge the gas from the ink flow channels 47*a* to 47*d* to the gas chamber 49 through the gas permeable film 60.

Here, since the ink flow channels 47*a* to 47*d* extend in the vertical direction and are connected to the inkjet head 3 at the ink supply ports 48*a* to 48*d* disposed at the lower end portions of the ink flow channels 47*a* to 47*d*, the ink flows vertically in the ink flow channels 47*a* to 47*d* toward the ink-jet head 3. Accordingly, when the gas flows into the flow channels 47*a* to 47*d*, the liquid level of the ink in the ink flow channels 47*a* to 47*d* is surely lowered. By setting the extending direction of the ink flow channels 47*a* to 47*d* to the vertical direction, it is possible to minimize the sizes of the ink flow channels 47*a* to 47*d* in the horizontal direction.

When the ink in the ink flow channels 47*a* to 47*d* is thickened, the thickened ink may be attached to the gas permeable film 60 and the gas permeable film 60 may be clogged by the thickened ink. However, since the ink flow channels 46*a* to 46*d* connected to the upstream ends of the ink flow channels 47*a* to 47*d* extend in the horizontal direction and the connecting portions to the ink flow channels 47*a* to 47*d* are located at the positions overlapping with the gas permeable film 60 in the horizontal direction, the ink flowing in the ink flow channels 47*a* to 47*d* from the ink flow channels 46*a* to 46*d* flows toward the gas permeable film 60 in the horizontal direction. Accordingly, the ink thickened and attached to the gas permeable film 60 is removed by the flow of ink flowing from the ink flow channels 46*a* to 46*d* into the ink flow channels 47*a* to 47*d*.

The discharge unit 23 forms a discharge channel discharging the gas in the sub-tank body 22 to the outside, and includes a connecting portion 61 and a discharge tube 62. The connecting portion 61 is disposed at positions overlapping with the ink flow channels 47*a* to 47*d* and the gas chamber 49 as viewed from the top side of the sub-tank body 22 so as to cover the ink flow channels 47*a* to 47*d* and the gas chamber 49 above the ink flow channels 47*a* to 47*d* and the gas chamber 49. A communication channel 63 and a gas chamber 65 forming the discharge channel are included in the connecting portion 61.

The gas chamber 65 is disposed at a position overlapping with the ink flow channels 47*a* to 47*d* and the gas chamber 49 in the plan view so as to cover the ink flow channels 47*a* to 47*d* and the gas chamber 49. The communication channel 63 extends in the vertical direction between the gas chamber 49 and the gas chamber 65 and allows the gas chamber 49 to communicate with the gas chamber 65.

The discharge tube 62 is a cylindrical tube, one end of which is connected to substantially center portion of the lower side surface of the gas chamber 65 in FIG. 3, extends to the downside of FIG. 3, is bent to the left side of FIG. 3 in the middle way. The inflow tubes 31*a* to 31*d* and the discharge tube 62 are arranged in the scanning direction with a constant interval. The end of the discharge tube 62 extending to the left side of FIG. 3 is connected to the tube 7*a* (not shown in FIGS. 2 and 3).

Figure 5:
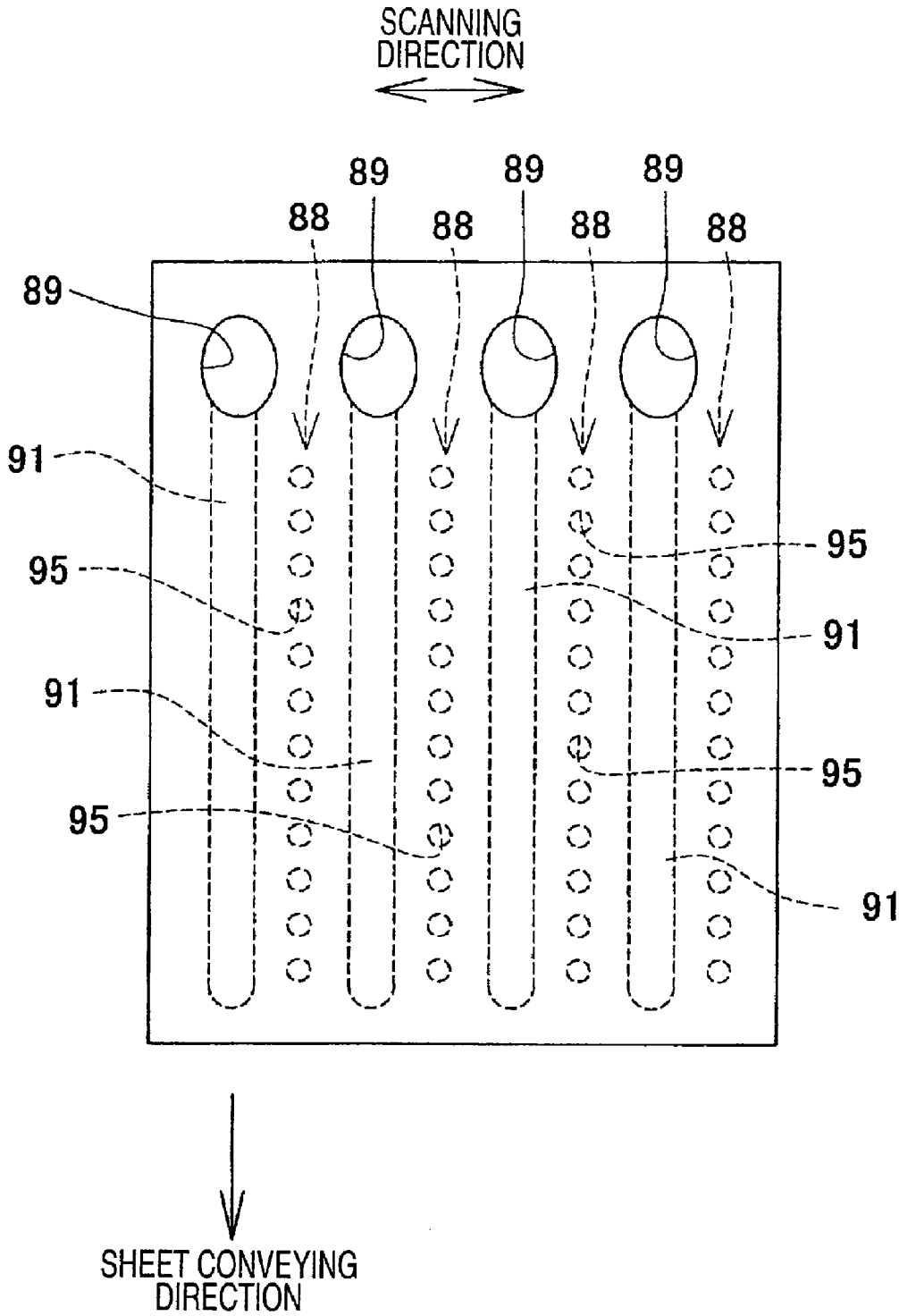
FIG. 5 is a plan view illustrating an ink-jet head shown in FIG. 1.
Figure 6:
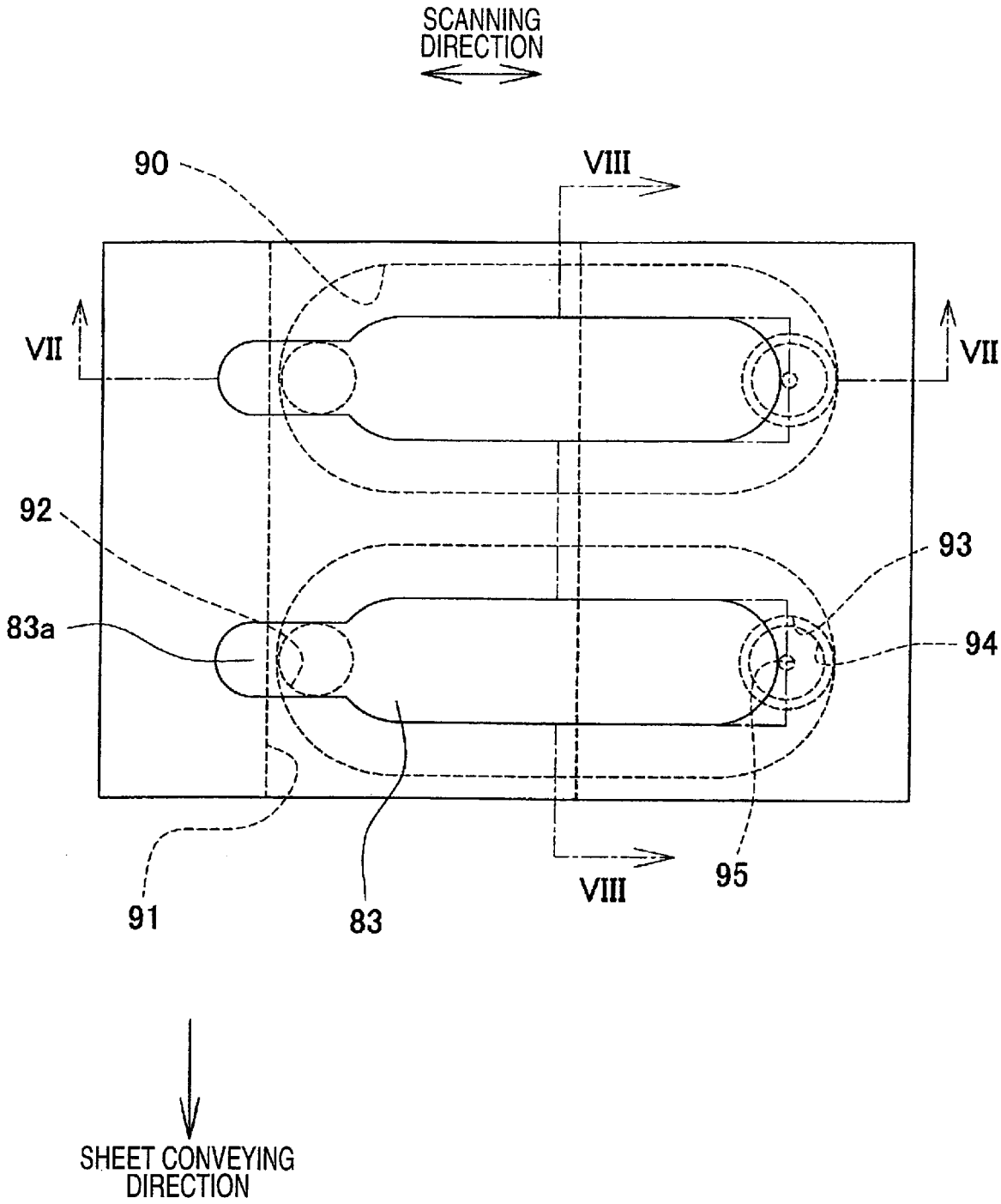
FIG. 6 is a partially enlarged view of FIG. 5.
Figure 7:
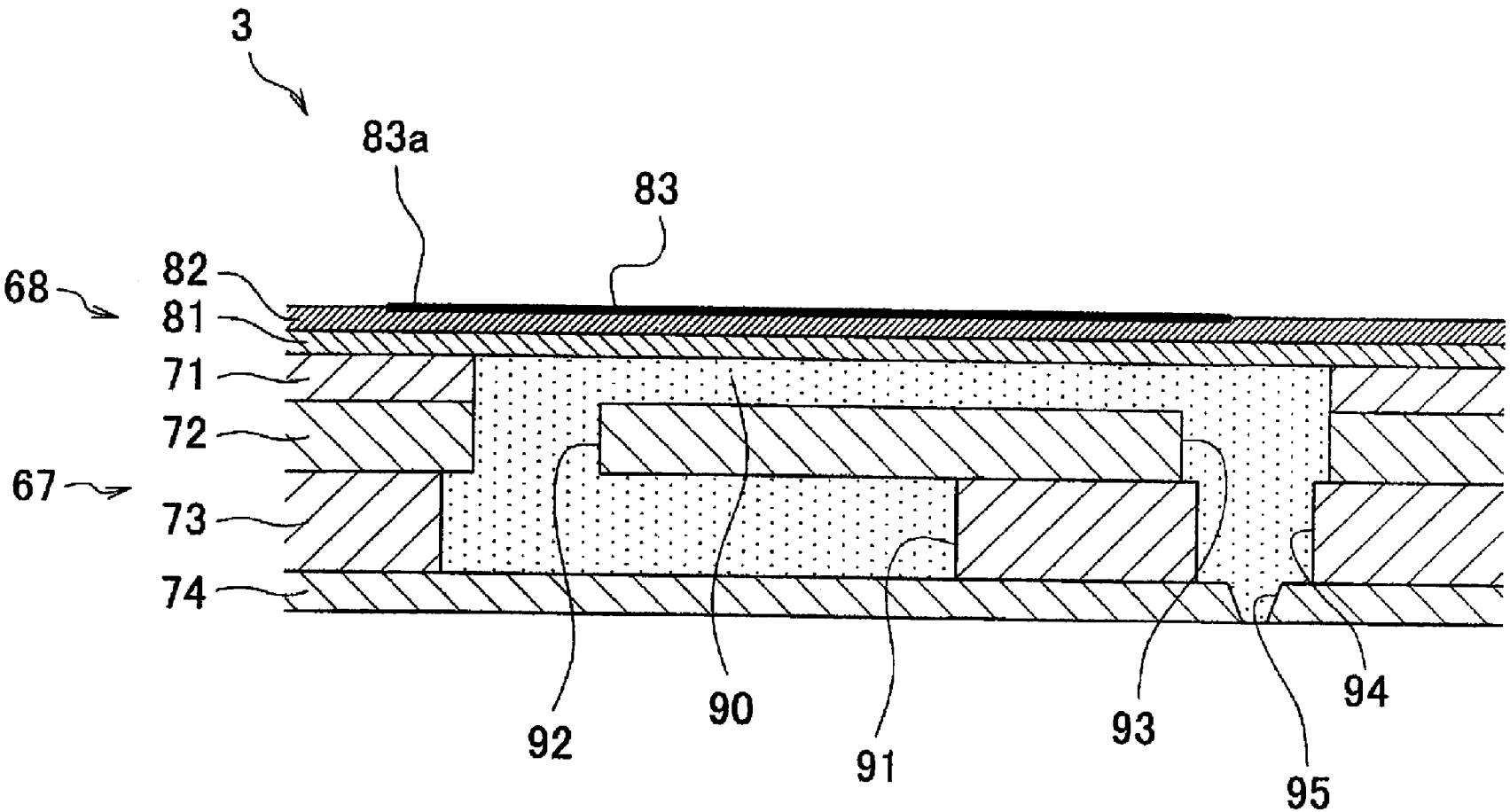
FIG. 7 is a sectional view taken along line VII-VII of FIG. 6.
Figure 8:
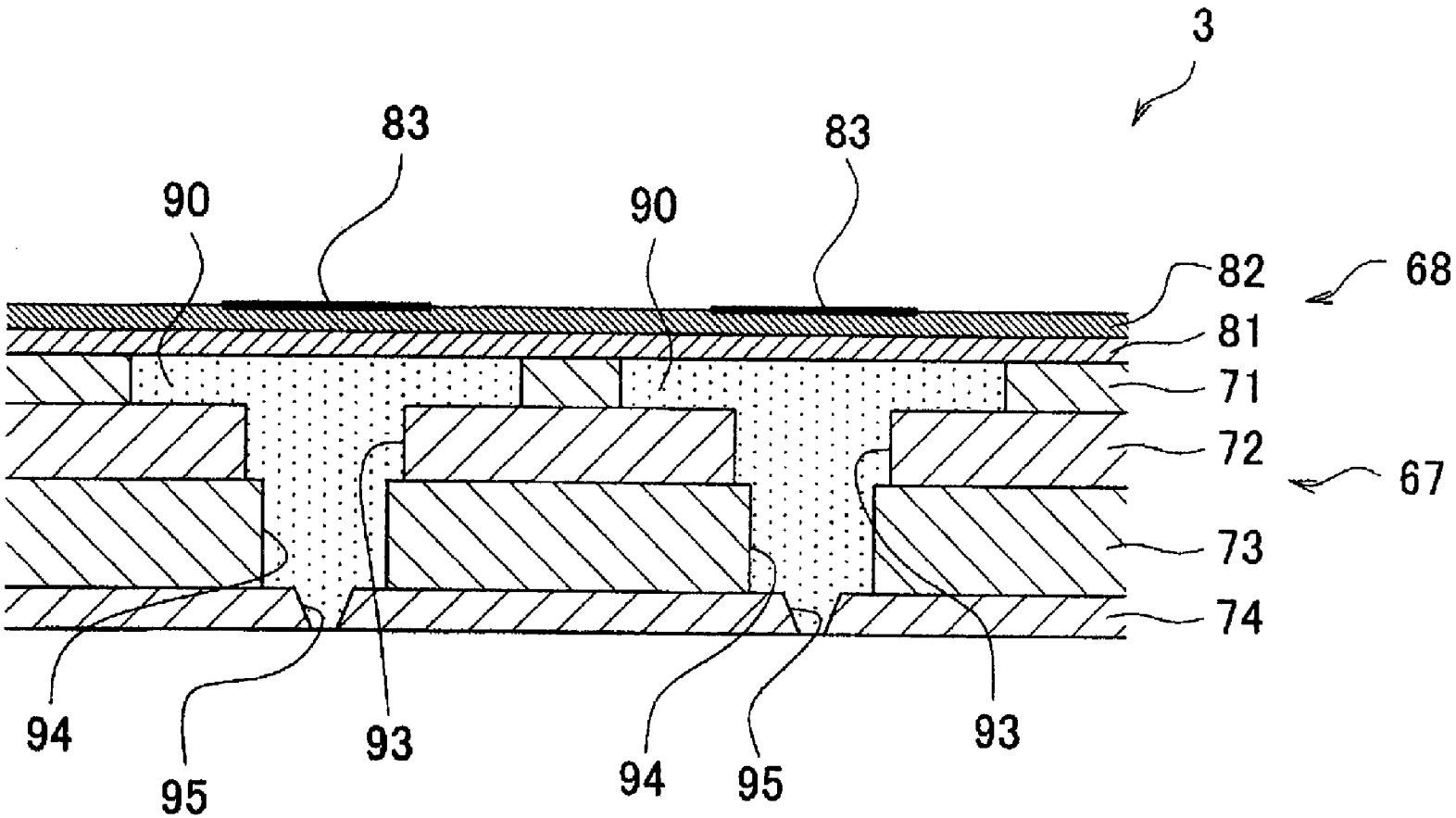
FIG. 8 is a sectional view taken along line VIII-VIII of FIG. 6.

The ink-jet head 3 will be described now. FIG. 5 is a plan view of the ink-jet head 3 shown in FIG. 1. FIG. 6 is a partially enlarged view of FIG. 5. FIG. 7 is a sectional view taken along line VII-VII of FIG. 6. FIG. 8 is a sectional view taken along line VIII-VIII of FIG. 6. Here, for the purpose of easily understanding the drawings, in FIG. 5, a pressure chamber 90 and through holes 92 to 94 (described later) are not shown and the nozzles 95 are more enlarged than those of FIGS. 6 to 8.

As shown in FIGS. 5 to 8, the ink-jet head 3 includes a flow channel unit 67 having an ink flow channel such as the pressure chamber 90 formed therein and a piezoelectric actuator 68 disposed on the top surface of the flow channel unit 67.

The flow channel unit 67 is formed by stacking four plates of a cavity plate 71, a base plate 72, a manifold plate 73, and a nozzle plate 74 sequentially from the top side. Among the four plates 71 to 74, three plates 71 to 73 other than the nozzle plate 74 are made of a metal material such as stainless and the nozzle plate 74 is made of a synthetic resin material such as polyimide. Alternatively, the nozzle plate 74 may be made of the metal material, similarly to the three plates 71 to 73.

Plural nozzles 95 are formed in the nozzle plate 74. The plural nozzles 95 are arranged in the sheet conveying direction (vertical direction in FIG. 5) to form nozzle rows 88. Four nozzle rows 88 are arranged in the scanning direction (horizontal direction in FIG. 5). The four nozzle rows 88 including the nozzles 95 for ejecting black, yellow, cyan, and magenta are arranged sequentially from the left nozzle row 88 in FIG. 5.

Plural pressure chambers 90 are formed in the cavity plate 71 to correspond to the plural nozzles 95. The pressure chambers 90 have a substantially elliptical planar shape having the scanning direction as its longitudinal direction and the right end of each pressure chamber 90 overlaps with the corresponding nozzle 95 in the plan view. The base plate 72 has through holes 92 and 93 formed at positions overlapping with both ends in the longitudinal direction of the pressure chamber 90 in the plan view.

Four manifold flow channels 91 extending in the sheet conveying direction are formed on the left side of the nozzle rows 88 in the manifold plate 73 to correspond to the four nozzle rows 88. Each manifold flow channel 91 overlaps with substantially the left half of the corresponding pressure chamber 90 in the plan view. The manifold flow channels 91 include ink supply holes 89, respectively in the upper ends of FIG. 5. The ink supply holes 89 are connected to the ink supply ports 48*a* to 48*d* of the sub-tank 4 as described above, and the ink in the sub-tank 4 is supplied to the manifold flow channels 91 through the ink supply holes 89. The manifold plate 73 has through holes 94 formed at positions overlapping with the through holes 93 and the nozzles 95 in the plan view.

In the flow channel unit 67, the manifold flow channel 91 communicates with the pressure chamber 90 through the through hole 92 and the pressure chamber 90 communicates with the nozzle 95 through the through holes 93 and 94. In this way, plural individual ink flow channels extending from the exits of the manifold flow channels 91 to the nozzles 95 through the pressure chambers 90 are formed in the flow channel unit 67.

The piezoelectric actuator 68 includes a vibrating plate 81, a piezoelectric layer 82, and plural individual electrodes 83. The vibrating plate 81 is made of a conductive material such as a metal material and is bonded to the top surface of the cavity plate 71 to cover the plural pressure chambers 90. The vibrating plate 81 having conductivity serves as a common electrode for applying an electric field to a portion of the piezoelectric layer 82 between the individual electrodes 83 as described later, is connected to a driver IC (not shown), and is always maintained in a ground potential.

The piezoelectric layer 82 has mixed crystals of lead titanate and lead zirconate, is made of a piezoelectric material containing lead zirconate titanate as a main component and having a ferroelectric property, and is disposed continuously on the top surface of the vibrating plate 81 to cover the plural pressure chambers 90. The piezoelectric layer 82 is polarized in advance in its thickness direction.

The plural individual electrodes 83 are disposed on the top surface of the piezoelectric layer 82 to correspond to the plural pressure chambers 90. The individual electrodes 83 have a substantially elliptical planar shape slightly smaller than the pressure chambers 90 and are disposed at positions overlapping with the center portions of the pressure chambers 90 in the plan view. An end (left end in FIG. 6) in the longitudinal direction of each individual electrode 83 extends to the left side up to the position not overlapping with the pressure chamber 90 in the plan view and the end portion serves as a contact point 83*a*. The contact point 83*a* is connected to the driver IC (not shown) through a wiring member such as a flexible printed circuit board (FPC, not shown). A driving voltage is selectively applied to the individual electrodes 83 by the driver IC.

Here, a method of driving the piezoelectric actuator 68 will be described. In the piezoelectric actuator 68, the potentials of the individual electrodes 83 are maintained in a ground potential in advance by the driver IC (not shown). When the driving voltage is applied to one of the plural individual electrodes 83 by the driver IC, a potential difference is generated between the individual electrode 83 to which the driving voltage is applied and the vibrating plate 81 as the common electrode maintained in the ground potential and thus an electric field in the thickness direction is generated in the portion of the piezoelectric layer 82 interposed between the individual electrode 83 and the vibrating plate 81. Since the direction of the electric field is parallel to the polarization direction of the piezoelectric layer 82, the portion of the piezoelectric layer 82 contracts in the horizontal direction perpendicular to the polarization direction. Accordingly, portions of the vibrating plate 81 and the piezoelectric layer 82 opposed to the pressure chamber 90 corresponding to the individual electrode 83 to which the driving voltage is applied are deformed to be convex toward the pressure chamber 90 as a whole and the volume of the pressure chamber 90 decreases. Accordingly, the pressure of the ink in the pressure chamber 90 increases and the ink is ejected from the nozzle 95 communicating with the pressure chamber 90.

Figure 9:
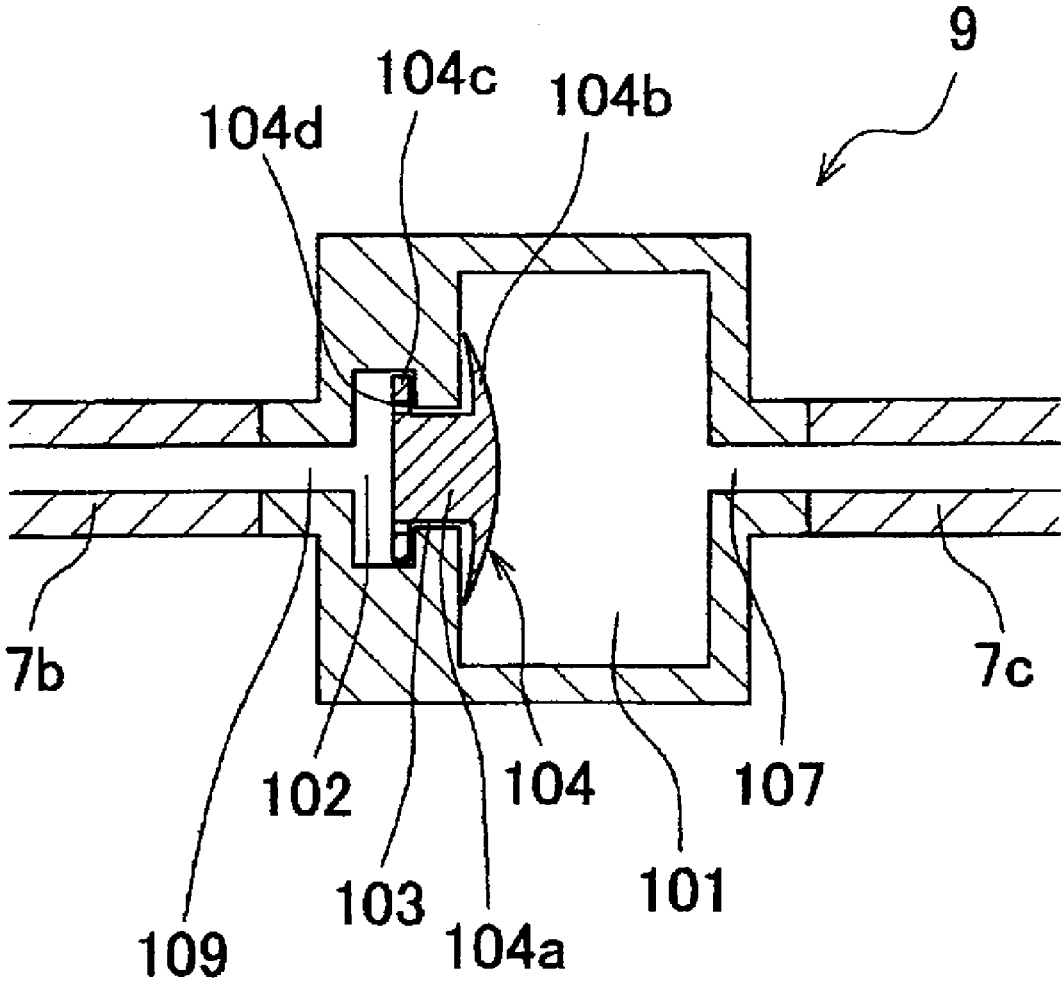
FIG. 9 is a sectional view illustrating a configuration of a differential pressure regulating valve shown in FIG. 1.

The differential pressure regulating valve 9 will be described now. FIG. 9 is a sectional view illustrating a configuration of the differential pressure regulating valve 9 shown in FIG. 1.

As shown in FIG. 9, the differential pressure regulating valve 9 includes gas chambers 101 and 102 and a communication channel 103 forming the discharge channel and a valve body 104. The gas chamber 101 and the gas chamber 102 are arranged in the horizontal direction of FIG. 9. The gas chamber 101 communicates with the tube 7*c* at a communication hole 107 disposed at the right end in FIG. 9 and the gas chamber 102 communicates with the tube 7*b* at a communication hole 109 disposed at the left end in FIG. 9. The communication channel 103 is a flow channel having a substantially circular shape as viewed in the horizontal direction of FIG. 9, extending in the horizontal direction between the gas chamber 101 and the gas chamber 102, and allowing the gas chamber 101 and the gas chamber 102 to communicate with each other and the diameter thereof is smaller than the length of the gas chambers 101 and 102 in the vertical direction and the direction perpendicular to the paper surface of FIG. 9.

The valve body 104 includes a cylindrical portion 104*a*, a blocking portion 104*b*, and a drop-preventing portion 104*c*. The cylindrical portion 104*a* has a substantially cylindrical shape having a diameter slightly smaller than that of the communication channel 103 and extends from the left end of the gas chamber 101 in FIG. 9 to the right end of the gas chamber 102 in FIG. 9 through the communication channel 103. The blocking portion 104*b* is disposed at the right end of the cylindrical portion 104*a* in FIG. 9 and extends from the cylindrical portion 104*a* to the outside in the diameter direction of the cylindrical portion 104*a* in a mountain shape, and its diameter is greater than the communication channel 103. The drop-preventing portion 104*c* is disposed at the left end of the cylindrical portion 104*a* in FIG. 9 and extends from the cylindrical portion 104*a* to the outside in the diameter direction of the cylindrical portion 104*a*, and its diameter is greater than that of the communication channel 103. Plural through holes 104*d* are formed in the drop-preventing portion 104*c* at positions overlapping with the edge of the communication channel 103 in the horizontal direction in FIG. 9.

When the gas in the discharge channel is suctioned by the suction pump 14, the valve body 104 moves to the right in FIG. 9 due to the suction force of the suction pump 14. Accordingly, a gap is generated between the blocking portion 104*b* and the left wall of the gas chamber 101 in FIG. 9 (the valve is opened). As a result, the gas chamber 101 and the gas chamber 102 communicate with each other through the through hole 104*d* and the communication channel 103. Accordingly, the discharge channel communicates with the switching unit 15 (suction pump 14). At this time, since the right surface of the drop-preventing portion 104*c* comes in contact with the right wall of the gas chamber 102, the valve body 104 is prevented from dropping from the communication channel 103. By suctioning the gas in the discharge channel by the use of the suction pump 14, the pressure of the discharge channel decreases into a negative pressure lower than the atmospheric pressure.

On the other hand, the pressure of the gas chamber 102 is a negative pressure. Accordingly, after the gas in the discharge channel is suctioned by the suction pump 14, the valve body 104 is suctioned due to the negative pressure to move to the left in FIG. 8 and the outer edge of the blocking portion 104*b* is pressed against the left wall of the gas chamber 101 in FIG. 9. As a result, the gap between the blocking portion 104*b* and the left wall of the gas chamber 101 disappears and the communication between the gas chamber 101 and the gas chamber 102 through the communication channel 103 is blocked. At this time, the portion of the discharge channel between the differential pressure regulating valve 9 and the gas permeable film 60 does not communicate with the outside and is thus closed.

Accordingly, the portion of the discharge channel between the differential pressure regulating valve 9 and the gas permeable film 60 is maintained in the negative pressure. As a result, even after the gas in the discharge channel is suctioned by the suction pump 14, the gas in the ink flow channels 47*a* to 47*d* is suctioned due to the negative pressure and is discharge to the discharge channel.

In this way, when the pressure of the space in the discharge channel closer to the sub-tank 4 than the valve body 104 is sufficiently smaller than the pressure of the space in the discharge channel closer to the switching unit 15 (the suction pump 14) than the valve body 104 (when the pressure of the space in the discharge channel close to the sub-tank 4 is smaller and the difference in pressure between the two spaces is greater than a predetermined value), the differential pressure regulating valve 9 according to this exemplary embodiment blocks the communication between the two spaces. Otherwise (when the difference in pressure between the two spaces is smaller than the predetermined value or when the pressures of the two spaces are equal to each other or the pressure of the space in the discharge channel close to the switching unit 15 is smaller, the differential pressure regulating valve permits the communication between the two spaces. The differential pressure regulating valve 9 according to this exemplary embodiment is also a one-way valve permitting a flow of gas from the sub-tank 4 to the switching unit 15 and blocking a flow of gas from the switching unit 15 to the sub-tank 4.

Figure 10A:
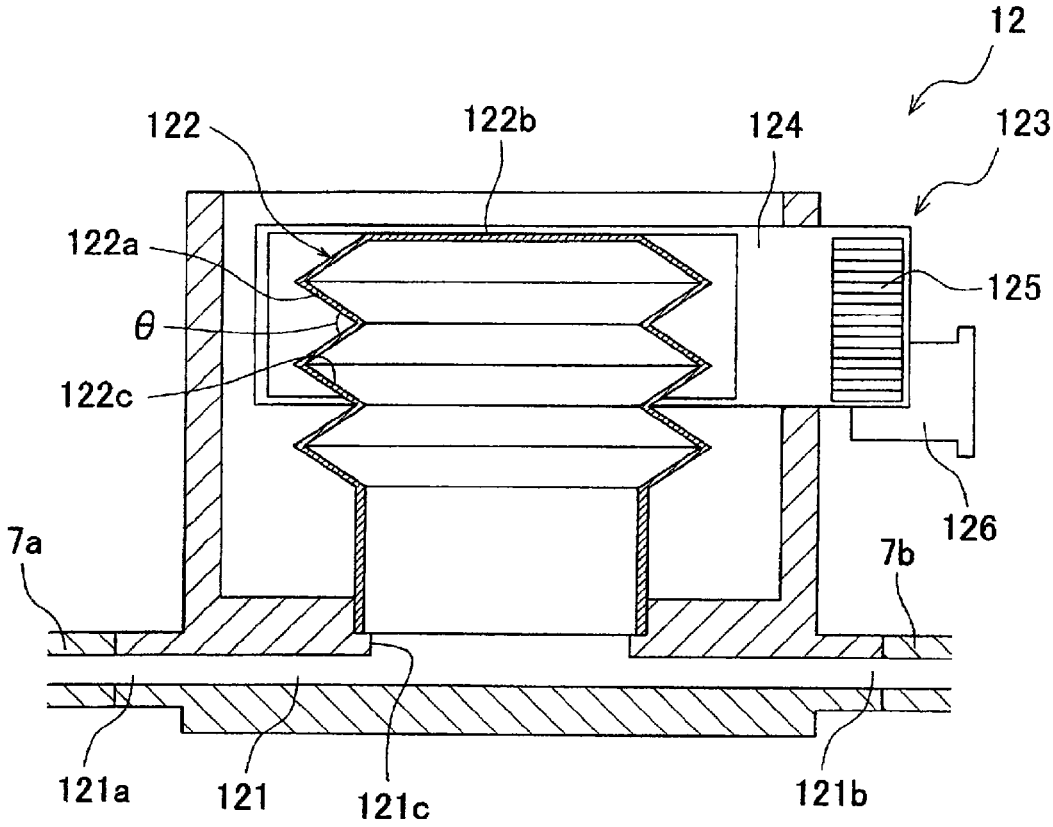
FIGS. 10A and 10B are sectional views illustrating a configuration of a charge tank shown in FIG. 1
Figure 10B:
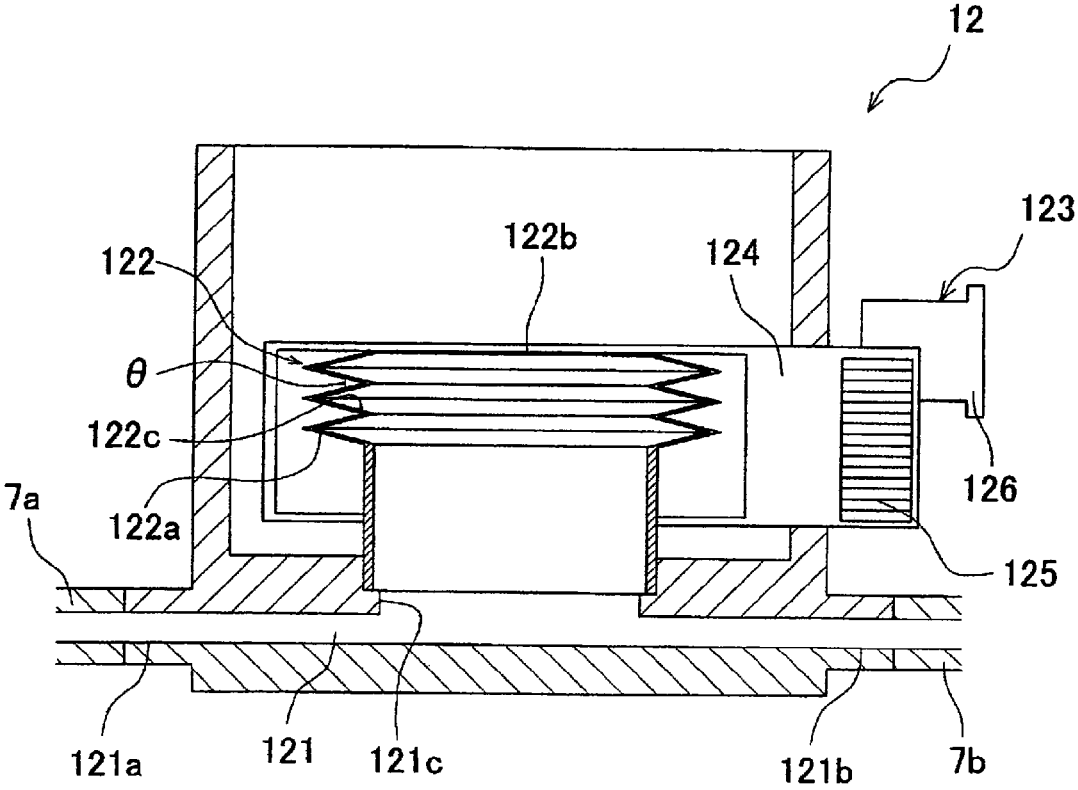
Figure 11C:
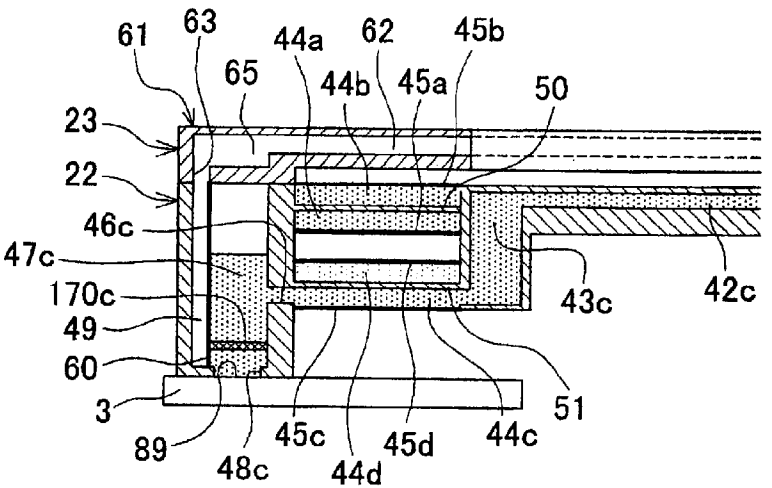
FIGS. 11A to 11D are diagrams illustrating a first modified exemplary embodiment, which correspond to FIGS. 4A to 4D.
Figure 11D:
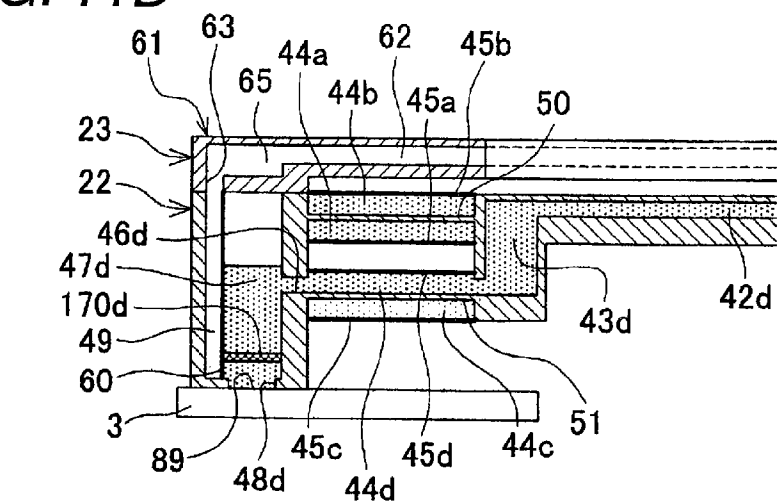
Figure 11A:
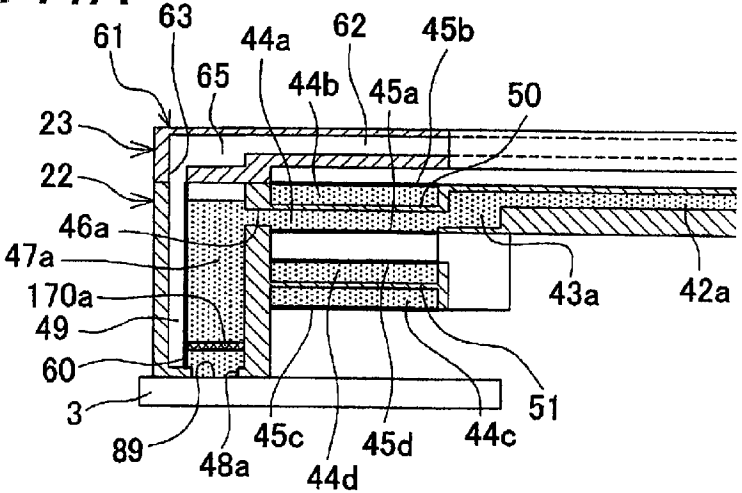
Figure 11B:
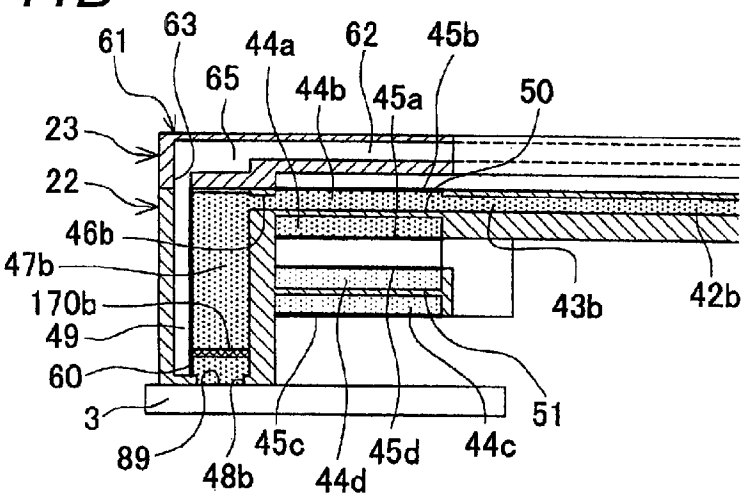
Figure 12A:
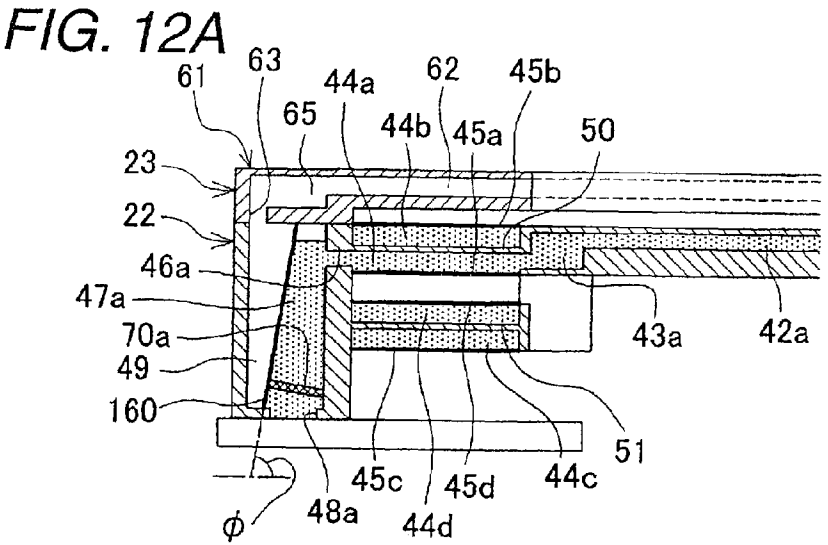
FIGS. 12A to 12D are diagrams illustrating a second modified exemplary embodiment, which correspond to FIGS. 4A to 4D.
Figure 12B:
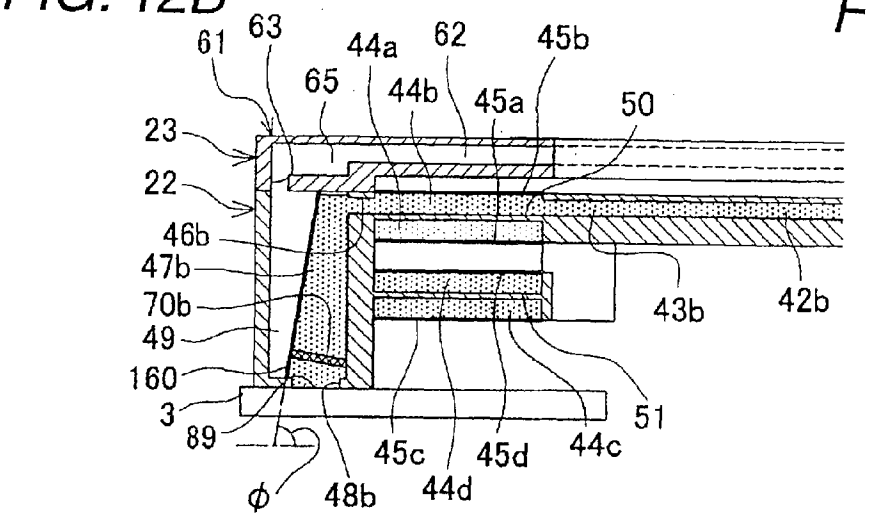
Figure 12C:
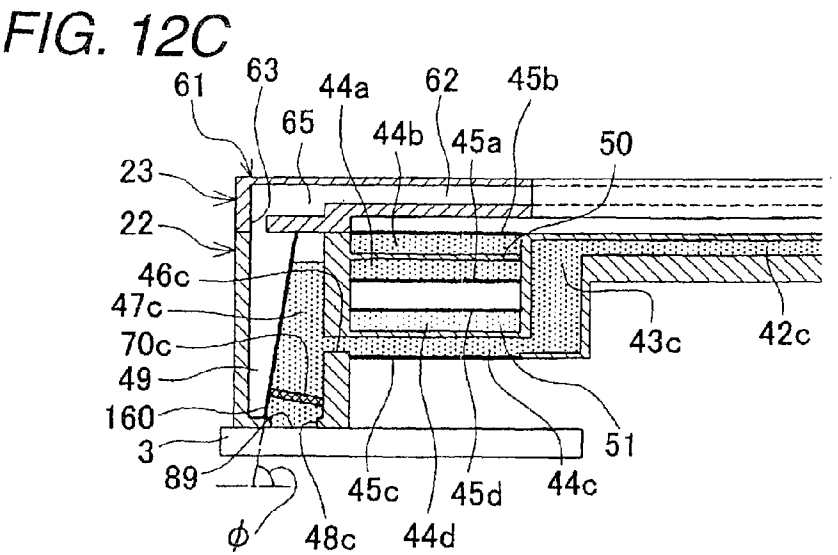
Figure 12D:
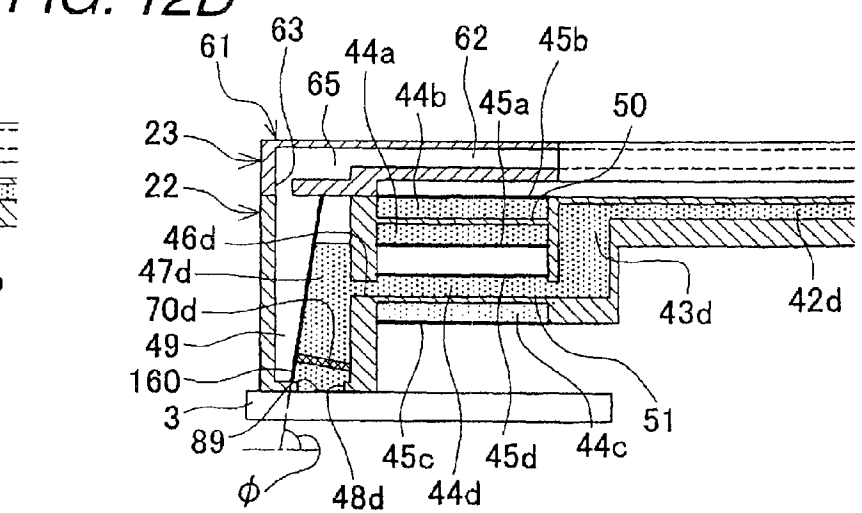

The charge tank 12 is described now. FIGS. 10A to 10B is a sectional view illustrating a configuration of the charge tank 12. Specifically, FIG. 10A shows a state where the pressure of a charge chamber 122*c* (described later) is the atmospheric pressure and FIG. 10B shows a state where the pressure of the charge chamber 122*c* is a negative pressure. As shown in FIGS. 10A and 10B, the charge tank 12 includes a gas flow channel 121 forming the discharge channel, a bellows portion 122, and a volume detecting sensor 123.

The gas flow channel 121 extends in the horizontal direction in FIGS. 10A and 10B and communicates with the tubes 7*a* and 7*b* at communication holes 121*a* and 121*b* disposed on both ends. A communication hole 121*c* allowing the gas flow channel 121 to communicate with a below-described charge chamber 122*c* of the bellows portion 122 is disposed in the top surface of the substantially center portion of the gas flow channel 121 in FIGS. 10A and 10B.

The bellows portion 122 extends in the vertical direction in FIGS. 10A and 10B and has a charge chamber 122*c* (volume varying chamber) surrounded with a top wall 122*b* and a side wall 122*a*. The top wall 122*b* is a wall defining the upper end of the charge chamber 122*c* and has a substantially circular planar shape. The side wall 122*a* is a wall defining the side surface of the charge chamber 122*c* and extends downward from the outer edges of the top wall 122*b* while being alternately bent in the opposite directions. Accordingly, by applying a vertical force to the top wall 122*b*, the top wall 122*b* moves in the vertical direction and the bending angle θ of the side wall 122*a* varies, whereby the volume of the charge chamber 122*c* varies. The lower end of the charge chamber 122*c* is opened and is connected to the communication hole 121*c*. Accordingly, the gas flow channel 121 communicates with the charge chamber 122*c*.

When the pressure of the charge chamber 122*c* is the atmospheric pressure, as shown in FIG. 10A, the top wall 122*b* of the bellows portion 122 is located at the highest position and the bending angle θ of the side wall 122*a* is the largest. When the pressure of the charge chamber 122*c* decreases by suctioning the gas from the tube 7*c* by actuating the suction pump 14, a downward force acts on the top wall 122*b* due to the difference between the external atmospheric pressure and the negative pressure of the charge chamber 122*c*. Accordingly, as shown in FIG. 10B, the top wall 122*b* moves down and the bending angle θ of the side wall 122*a* decreases with the movement. With the deformation of the bellows portion 122, the volume of the charge chamber 122*c* decreases.

Here, when the bending angle θ of the side wall 122*a* decreases, an upward restoring force for restoring the top wall to the state shown in FIG. 10A acts on the side wall 122*a* and the restoring force increases as the bending angle θ of the side wall 122*a* decreases. Accordingly, in the bellows portion 122, the variation in volume of the charge chamber 122*c* is stopped when the force resulting from the difference between the atmospheric pressure and the pressure of the charge chamber 122*c* is balanced with the restoring force. As a result, as the pressure of the charge chamber 122*c* becomes lower, the volume of the charge chamber 122*c* becomes smaller. That is, the pressure of the charge chamber 122*c* and the volume of the charge chamber 122*c* have a predetermined relation.

On the contrary, as shown in FIG. 10B, when the charge chamber 122*c* is maintained in the negative pressure and the gas in the ink flow channels 47*a* to 47*d* is discharged to the gas chamber 49 through the gas permeable film 60, the pressure of the charge chamber 122*c* communicating with the gas chamber 49 increases as much as the discharged gas. Accordingly, the downward force generated due to the difference between the atmospheric pressure and the pressure of the charge chamber 122*c* decreases, the top wall 122*b* of the bellows portion 122 moves up, and the bending angle θ of the side wall 122*a* increases with the movement. With the deformation of the bellows portion 122, the volume of the charge chamber 122*c* increases.

Here, since the charge chamber 122*c* communicates with the discharge channel, the total volume of the discharge channel and the charge chamber 122*c* increases as much as the volume of the charge chamber 122*c*, compared with the volume of the discharge channel not having the charge tank 12. Accordingly, the increase in pressure of the discharge channel can be slowed when the gas flows into the discharge channel from the ink flow channels 47*a* to 47*d*, thereby elongating the time when the discharge channel is maintained in the negative pressure. Even when the gas flows into the discharge channel from the ink flow channels 47*a* to 47*d* and the volume of the charge chamber 122*c* increases, the variation in volume of the charge chamber 122*c* is stopped by means of the balance between the force resulting from the difference between the atmospheric pressure and the pressure of the charge chamber 122*c* and the restoring force due to the side wall 122*a* of the bellows portion 122, similarly to the case where the gas in the discharge channel is suctioned by the suction pump 14. That is, in this case, the pressure of the charge chamber 122*c* and the volume of the charge chamber 122*c* have a predetermined relation.

The volume detecting sensor 123 includes a movable portion 124, plural slits 125, and a slit detecting sensor 126. The movable portion 124 moves up and down along with the top wall 122*b* of the bellows portion 122. The plural slits 125 are disposed at the right end of the movable portion 124 in FIGS. 10A and 10B, extend in the horizontal direction in the drawing, and are arranged in the vertical direction. The slit detecting sensor 126 detects that the slits 125 vertically pass through the slit detecting sensor 126. Since the plural slits 125 move up and down along with the top wall 122*b*, it is possible to detect the volume of the charge chamber 122*c* by detecting that the slits 125 pass through the slit detecting sensor 126 by the use of the slit detecting sensor 126.

As described above, the position of the top wall 122*b*, that is, the volume of the charge chamber 122*c*, and the pressure of the charge chamber 122*c* have a predetermined relation. Accordingly, the volume detecting sensor 123 can detect the pressure of the charge chamber 122*c* by detecting that the plural slits 125 disposed in the movable portion 124 moving up and down along with the top wall 122*b* pass through the slit detecting sensor 126 by the use of the slit detecting sensor 126.

According to the above-described exemplary embodiment, the ink flow channels 47*a* to 47*d* extend in the vertical direction (in the direction intersecting the horizontal direction) and the gas permeable film 60 forms a part of the side walls (the walls along the extending direction) of the ink flow channels 47*a* to 47*d*. Accordingly, as the amount of gas flowing into the ink flow channels 47*a* to 47*d* becomes increase, the liquid level in the liquid flow channels 47*a* to 47*d* is lowered and the contact area between the gas in the ink flow channels 47*a* to 47*d* and the gas permeable film 60 becomes large. Accordingly, even when a large amount of gas flows into the ink flow channels 47*a* to 47*d*, it is possible to efficiently discharge the gas in the ink flow channels 47*a* to 47*d*.

Here, since the ink flow channels 47*a* to 47*d* extend in the vertical direction and are connected to the ink-jet head 3 at the ink supply ports 48*a* to 48*d* at the lower end thereof, the ink flows through the ink flow channels 47*a* to 47*d* in the vertical direction to the ink-jet head 3. Accordingly, when the gas flows into the ink flow channels 47*a* to 47*d*, the liquid level of the ink in the ink flow channels 47*a* to 47*d* is surely lowered.

Since the ink flow channels 47*a* to 47*d* extend in the vertical direction, it is possible to minimize the sizes of the ink flow channels 47*a* to 47*d* in the horizontal direction.

In the ink flow channels 47*a* to 47*d*, the ink may be thickened and attached to the gas permeable film 60 and the gas permeable film 60 may be clogged by the attached ink. However, since the ink flow channels 46*a* to 46*d* connected to the upstream ends of the ink flow channels 47*a* to 47*d* extend in the horizontal direction and the ink flow channels 46*a* to 46*d* are connected to the ink flow channels 47*a* to 47*d* at the positions overlapping with the gas permeable film 60 in the horizontal direction (the horizontal direction in FIGS. 4A to 4D), the ink flowing into the ink flow channels 47*a* to 47*d* from the ink flow channels 46*a* to 46*d* flows to the gas permeable film 60. Accordingly, it is possible to remove the thickened ink attached to the gas permeable film 60 by the use of the flow of ink.

Bubbles can be easily attached to the surfaces of the filters 70*a* to 70*d*. However, since the filters 70*a* to 70*d* are disposed at the positions overlapping with the gas permeable film 60 in the horizontal direction, the bubbles attached to the filters 70*a* to 70*d* are discharged from the gas permeable film 60 to the gas chamber 49. Bubbles can be easily accumulated particularly on the lower surfaces of the filters 70*a* and 70*d*. However, since the filters 70*a* to 70*d* are tilted with respect to the horizontal direction so that the portion closer to the gas permeable film 60 is located higher, the bubbles attached to the lower surfaces of the filters 70*a* to 70*d* move to the end of the gas permeable film 60 along the lower surfaces of the filters 70*a* to 70*d*. Accordingly, it is possible to efficiently discharge the bubbles attached to the filters 70*a* to 70*d*.

While the present invention has been shown and described with reference to certain exemplary embodiments thereof, it will be understood by those skilled in the art that various changes in form and details may be made therein without departing from the spirit and scope of the invention as defined by the appended claims.

Various modified exemplary embodiments will be described. Here, elements similar to above-described exemplary embodiment are denoted by the same reference numerals and description thereof is properly omitted.

In a first modified exemplary embodiment, as shown in FIGS. 11A to 11D, filters 170*a* to 170*d* extend in the horizontal direction and are connected to the gas permeable film 60 at the left end portions in FIGS. 11A to 11D. In this case, since the gas attached to the filters 170*a* to 170*d* is discharged from the gas permeable film 60 to the gas chamber 49, it is possible to efficiently discharge the gas attached to the filters 170*a* to 170*d*.

In a second modified exemplary embodiment, as shown in FIGS. 12A to 12D, a gas permeable film 160 extends in a direction tilted with respect to the vertical direction and an intersection angle of the gas permeable film 160 with respect to the horizontal direction (the horizontal direction in FIGS. 12A to 12D) is $\phi$. In this case, as the amount of gas flowing into the ink flow channels 47*a* to 47*d* becomes greater, the liquid level of the ink flow channels 47*a* to 47*d* is lowered and the contact area between the gas in the ink flow channels 47*a* to 47*d* and the gas permeable film 160 becomes greater. Accordingly, even when a large amount of gas flows into the ink flow channels 47*a* to 47*d*, it is possible to efficiently discharge the gas. As the extending direction of the gas permeable film 160 gets closer to the horizontal direction, the size of the ink flow channels 47*a* to 47*d* in the horizontal direction (the horizontal direction in FIGS. 12A to 12D) becomes greater. Accordingly, in view of preventing such increase in the size of ink flow channels 47*a* to 47*d* in the horizontal direction, it is preferable that the intersection angle (p of the gas permeable film 160 with respect to the horizontal direction is in the range of 45° to 135° (when ($\phi$=90°, the configuration of the above-described exemplary embodiment is obtained).

Although the ink flow channels 47*a* to 47*d* extend in the vertical direction in the above-described exemplary embodiment, the inventive concept of the present invention is not limited to the configuration. The ink flow channels 47*a* to 47*d* may extend in the direction intersecting the horizontal direction other than the vertical direction. In this case, as the amount of gas flowing into the ink flow channels 47*a* to 47*d* becomes greater, the liquid level of the ink in the ink flow channels 47*a* to 47*d* is lowered and the contact area between the gas in the ink flow channels 47*a* to 47*d* and the gas permeable film 60 becomes greater. In this case, in order to prevent the ink flow channels 47*a* to 47*d* from excessively increasing in size in the horizontal direction, it is preferable that the intersection angle of the ink flow channels 47*a* to 47*d* about the horizontal direction is in the range of 45° to 135°, similarly to the gas permeable film as described above.

In the above-described exemplary embodiment, the filters 70*a* to 70*d* are disposed in the ink flow channels 47*a* to 47*d*. However, the filters may be disposed at positions other than the ink flow channels 47*a* to 47*d*.

In the above-described exemplary embodiment, the ink flow channels 46*a* to 46*d* connected to the upstream ends of the ink flow channels 47*a* to 47*d* extend in the horizontal direction and are connected to the ink flow channels 47*a* to 47*d* at the positions opposed to the gas permeable film 60 in the horizontal direction. However, the extending direction of the ink flow channels 46*a* to 46*d* and the connecting positions to the ink flow channels 47*a* to 47*d* are not limited to the above-described configuration.

In the above-described exemplary embodiment, it is described that the gas permeable film 60 forms the walls of the ink flow channels 47*a* to 47*d* formed in the sub-tank 4 in the extending direction thereof. However, the inventive concept of the present invention is not limited to this configuration. The gas permeable film may form a wall surface in the extending direction of the portions (first liquid flow channel) extending in a direction intersecting the horizontal direction other than the ink flow channels 47*a* to 47*d*, in the ink flow channels extending from the ink cartridges 6*a* to 6*d* to the ink-jet head 3.

Although it has been described above that the invention is applied to a printer ejecting ink from the nozzles, the invention may be applied to liquid ejecting devices ejecting liquids other than ink from nozzles.

What is claimed is:

1. A liquid ejecting device comprising:

a liquid ejecting head including a nozzle for ejecting a liquid, wherein the liquid is ejected from the nozzle in an ejecting direction;

a liquid supply channel connected to the liquid ejecting head to supply the liquid to the liquid ejecting head;

a discharge channel connected to the liquid supply channel through a connecting portion to discharge a gas in the liquid supply channel;

a gas permeable film disposed in the connecting portion between the liquid supply channel and the discharge channel, the gas permeable film configured to pass the gas and do not pass the liquid, the gas permeable film partitioning the liquid supply channel and the discharge channel; and a suction unit connected to the discharge channel so as to suction the gas in the discharge channel, wherein the liquid supply channel includes a first liquid flow channel extending in an extending direction intersecting a horizontal direction perpendicular to the ejecting direction, and wherein the gas permeable film defines a part of the first liquid flow channel, the part of the first liquid flow channel extending in the extending direction.

2. The liquid ejecting device according to claim 1, wherein the liquid supply channel further includes a second liquid flow channel connected to an upstream portion of the first liquid flow channel through a connecting portion, wherein the second liquid flow channel extends in the horizontal direction, and wherein the connecting portion between the first liquid flow channel and the second liquid flow channel is located at a position overlapping with the gas permeable film in the horizontal direction.

3. The liquid ejecting device according to claim 1, wherein an intersection angle of the gas permeable film with respect to the horizontal direction is in the range of 45° to 135°.

4. The liquid ejecting device according to claim 1, wherein the first liquid flow channel extends in a vertical direction perpendicular to the horizontal direction, and wherein a downstream end of the first liquid flow channel is connected to the liquid ejecting head.

5. The liquid ejecting device according to claim 1, further comprising a filter for removing particles from the liquid flowing in the first liquid flow channel, wherein the filter is provided at a position overlapping with the gas permeable film in the horizontal direction.

6. The liquid ejecting device according to claim 5, wherein the filter is tilted with respect to the horizontal direction so that a portion of the filter closer to the gas permeable film is located higher.

7. The liquid ejecting device according to claim 1, wherein the liquid ejecting head includes a nozzle surface provided with the nozzle, and wherein the horizontal direction is parallel to the nozzle surface.

8. The liquid ejecting device according to claim 5, wherein the filter is connected to the gas permeable film.

* * * * *